US005593190A

United States Patent [19]

Shepard

[11] Patent Number: 5,593,190

[45] Date of Patent: Jan. 14, 1997

[54] CONSISTENT-FORCE QUICK LATCHING SYSTEM

[75] Inventor: James E. Shepard, Atlanta, Ga.

[73] Assignee: The United States of America as represented by the Secretary of the Army, Washington, D.C.

[21] Appl. No.: 528,625

[22] Filed: Sep. 11, 1995

[51] Int. Cl.[6] ..... E05C 19/10

[52] U.S. Cl. ..... 292/98; 292/100; 292/257

[58] Field of Search ..... 292/98, 100, 101, 292/257

[56] References Cited

U.S. PATENT DOCUMENTS

| | | | |
|---|---|---|---|
| 186,665 | 1/1877 | Davis et al. | 292/98 |
| 1,229,851 | 6/1917 | Abercrombie | 292/257 |
| 5,018,690 | 5/1991 | Widmer | 292/113 |

FOREIGN PATENT DOCUMENTS

| | | | |
|---|---|---|---|
| 740930 | 11/1932 | France | 292/98 |
| 1277691 | 9/1968 | Germany | 292/98 |

*Primary Examiner*—Rodney M. Lindsey

*Attorney, Agent, or Firm*—Freddie M. Bush; Hay Kyung Chang

[57] ABSTRACT

The Consistent-Force Quick Latching System (CQLS) provides a means for attaching and detaching two objects quickly, using consistent force regardless of the dimensions of the individual objects. The CQLS, usually secured to object A, utilizes a notched cam and a detent that enters one of the notches in response to externally applied pressure and rotates the cam in conjunction with the rotation of a handle that is pivotally coupled to the cam. When the handle rotates in one direction, the cam rotates so as to raise the hook that is also pivotally coupled to the cam, thereby forcing against object A object B that has been slid onto the hook. The two objects are separated from each other by a release mechanism that pulls the detent out of a notch, allowing the handle to rotate in the opposite direction. This lowers the pivot point and thus the hook, resulting in separation of object B from object A.

19 Claims, 4 Drawing Sheets

CONSISTENT-FORCE QUICK LATCHING SYSTEM

DEDICATORY CLAUSE

The invention described herein may be manufactured, used and licensed by or for the Government for governmental purposes without the payment to me of any royalties thereon.

BACKGROUND OF THE INVENTION

All known extant quick latch devices produce a consistent joining force only if they do not wear out with time and use or when a pair of objects being joined together does not vary in dimension from any other pair of objects being joined by the same device. Otherwise, such devices must be adjusted for each pair of items to be joined together in order to provide the same consistent force from one joining to the next, the nature and degree of adjustment depending on the various parameters of the items. A latching system that clasps any two objects together with consistent force from one joining to the next regardless of the dimensions of any particular pair of items or the skills of the system operator would be useful. Such a system would be especially useful in quickly and easily attaching launchers to a mount such as the XM-1101 and just as quickly and easily detaching the same launchers when they are no longer functional.

The XM-1101, in essence, is an improved TOW vehicle in which the TOW launchers are replaced with a fixture to hold two M261 launchers. Unfortunately however, the lifespan of the M261 launchers is short, necessitating the ability to change out the launchers quickly and easily. Further, this changing out of the launchers needs to be accomplished with precise amount force. If the M-261 launcher is attached too loosely, for instance, the vibrations resulting from the launching can damage the launcher and the rockets as well as affect the accuracy of the entire launching system. Therefore, the successive launchers need to be attached to the mount at a consistent force without regard to factors such as differing dimensions, operator's skills and other conditions and preferably without the need for special measuring tools.

SUMMARY OF THE INVENTION

The Consistent-Force Quick Latching System (CQLS) joins a pair of objects, such as a rocket launcher and the mount, quickly and easily, with consistent attaching force from joining of one pair to the joining of the next pair, without the need for external adjustments to accomodate for the differing dimensions of the objects to be joined or variances in the operators' skills. The CQLS also detaches two previously joined items quickly and easily.

The CQLS performs its attaching and detaching functions with consistent force by utilizing a rotatable notched cam and a detent that is adapted to slide in and out of the several notches when the cam is rotating in a given direction but not when it is rotating in the opposite direction. The cam resides on the mount and is rotated by a handle. As the handle rotates in a given direction, the detent that is housed within the handle along with a means for delivering an appropriate amount of pressure to the detent, is motivated to move in and out of the notches in sequence in response to the rotation of the handle. The rotation of the handle, hence of the cam, either raises or lowers the hook that is pivotally coupled to the cam and the handle, thereby attaching to or detaching from the mount the launcher that is held by the hook.

DESCRIPTION OF THE PREFERRED EMBODIMENT

With reference now to the figures wherein like numbers denote like parts, the structure and operation of the Consistent-Force Quick Latching System (CQLS) is explained.

Figure 1:
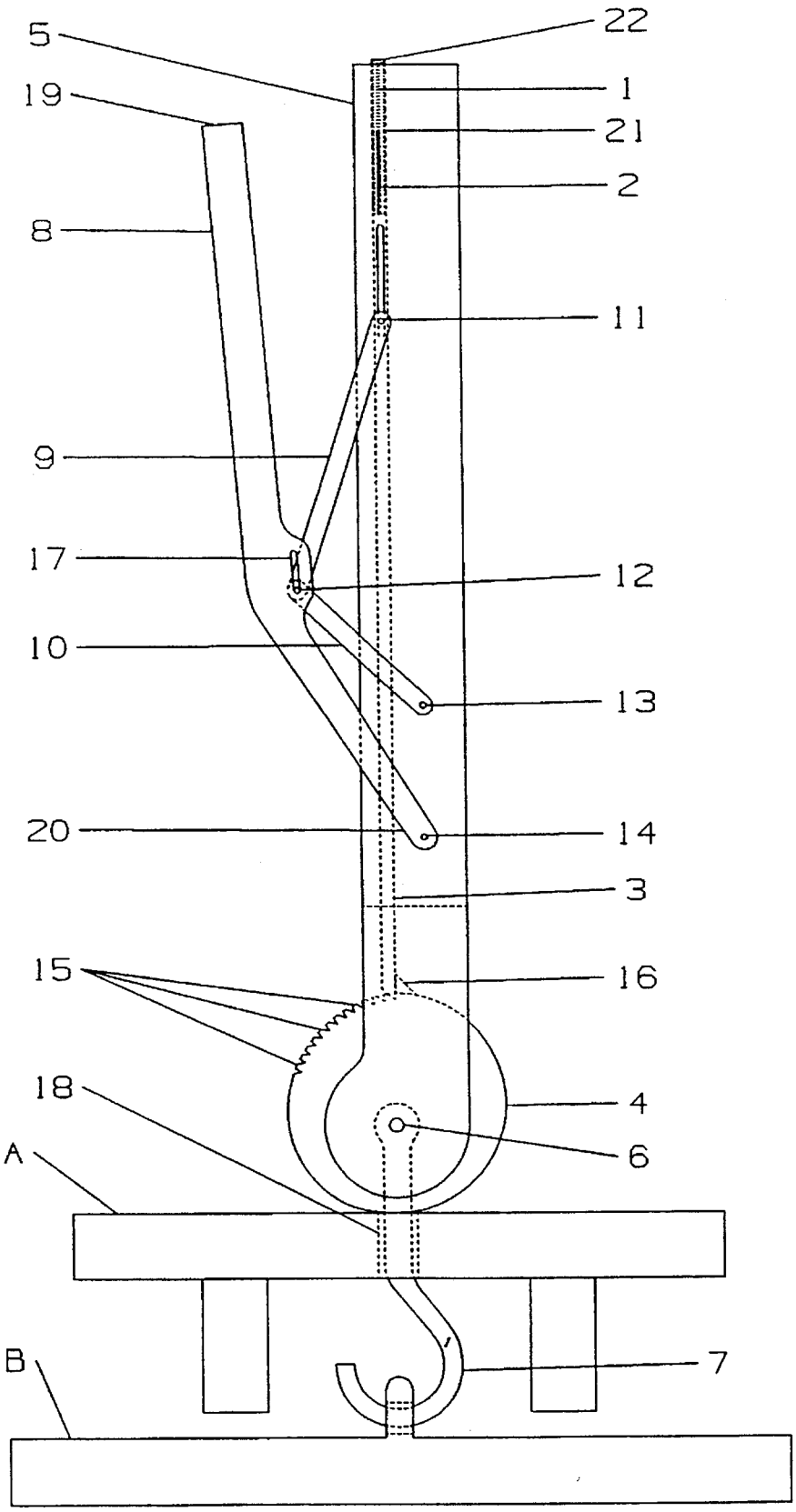
FIG. 1 presents a side cross-sectional view of the preferred embodiment of the Consistent-Force Quick Latching System (CQLS).
Figure 2:
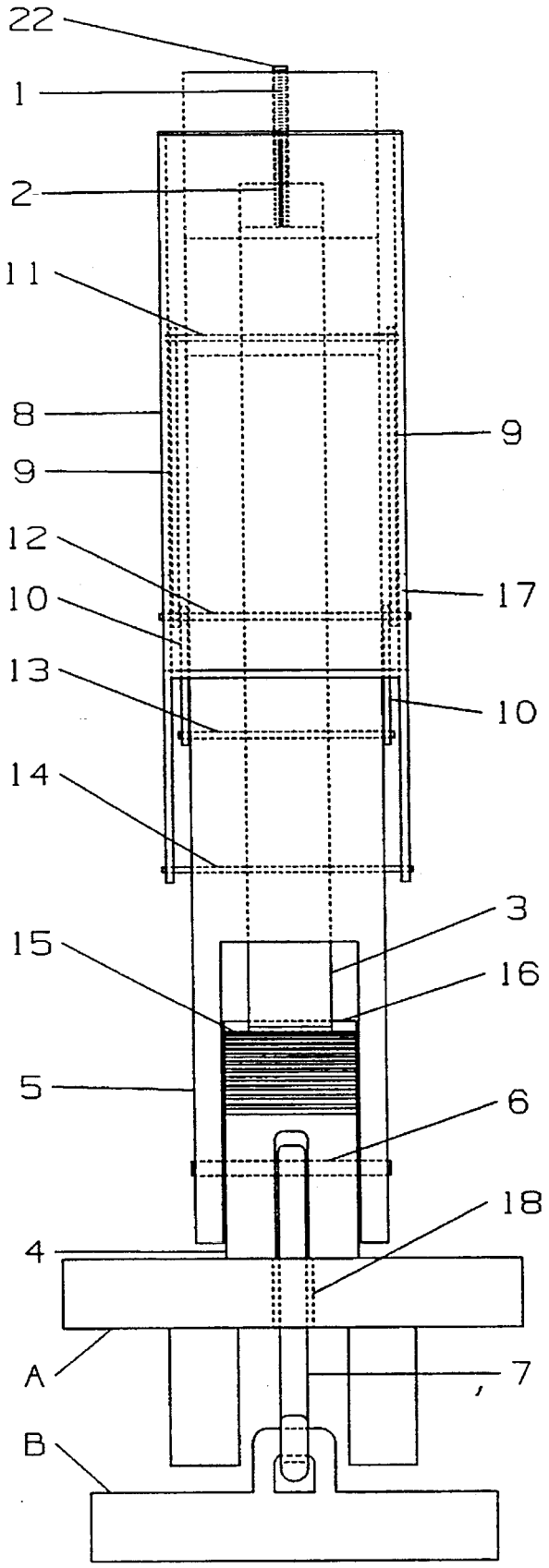
FIG. 2 shows a frontal cross-sectional view of the preferred embodiment of the CQLS.

At the beginning of the fastening cycle, handle 5 is brought to an upright position with respect to object A on which the entire system rests. Then screw 1 is tightened by threading it sufficiently into tubular channel 21 to elicit the desired amount of pressure on spring 2. With the exception of screw head 22 which extrudes from handle 5, the screw is susceptible to being inserted in its entirety into channel 21. The channel, in ram, is located within the interior of the handle and nuns along the length of the handle and additionally houses within it detent 3 and spring 2, the spring being sandwiched, as shown in FIGS. 1 and 2, between the screw and the detent. The force exerted by screw 1 when tightened into the channel is transfered therefrom via the compressed spring to the detent.

While the handle is thusly in an upright position, object B, chosen to be attached to object A, is slid onto hook 7 that passes through hole 18 in object A and hangs beneath object A. Then handle 5 is rotated downward in counterclockwise direction. As the handle rotates, detent 3, which is inside the handle, is forced by spring 2 into one of notches 15 that are present on the sin-face of cam 4, covering a quarter of the circumference of the cam. The friction and mechanical advantage of the detent thusly resting in the notch causes a transfer of force from the handle to the cam. This transfer of force makes the cam rotate along with the handle, thereby raising the pivot pin 6. Since handle 5, cam 4 and hook 7 are coupled together by pivot pin 6, the raising of the pivot pin results in the raising of the hook toward object A, thereby bringing objects A and B together.

Figure 3:
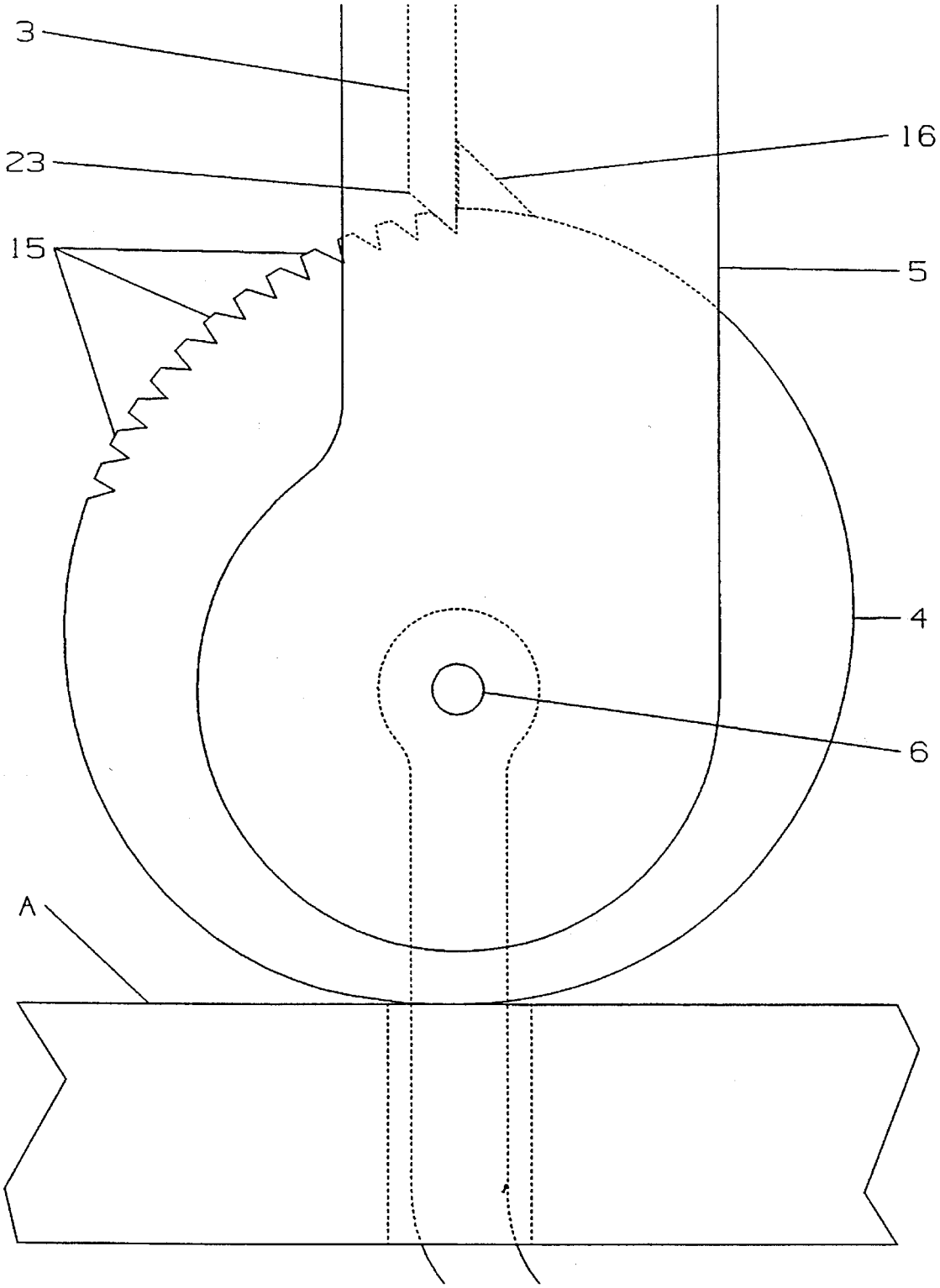
FIG. 3 is an enlarged cross-sectional depiction of the details of the cam.

Rotating the handle further increases the force between objects A and B as well as the force between object A and the cam. Such increasing force between the rotating cam and object A requires more force to be applied to the handle in order to continue the counter-clockwise motion of the handle. When enough force has been applied to the handle, then the force between detent 3 and the notch in which it is resting overcomes the friction and mechanical advantage of the detent, causing the detent to slide out of the notch. From this point and on, cam 4 no longer rotates with the handle since the mechanical connection between the two has been broken. The detent merely slides in and out of the remaining notches while the handle is rotated all the way to the horizontal position. As illustrated in detail in FIG. 3, the shapes of notches 15 on cam 4 and tip 23 of detent 3 will not permit the cam to rotate in clockwise direction while the detent slides in and out of the notches. Such a clockwise rotation of the cam would allow the force between objects A and B to be decreased, tending to separate the objects. When the handle is in the horizontal position after having rotated in counter-clockwise direction, the detent slides into a notch and the fastening cycle is complete. A locking mechanism, not shown in the figures, may hold the handle in the horizontal position while object B, in its attached condition to object A, is put to use.

Figure 4:
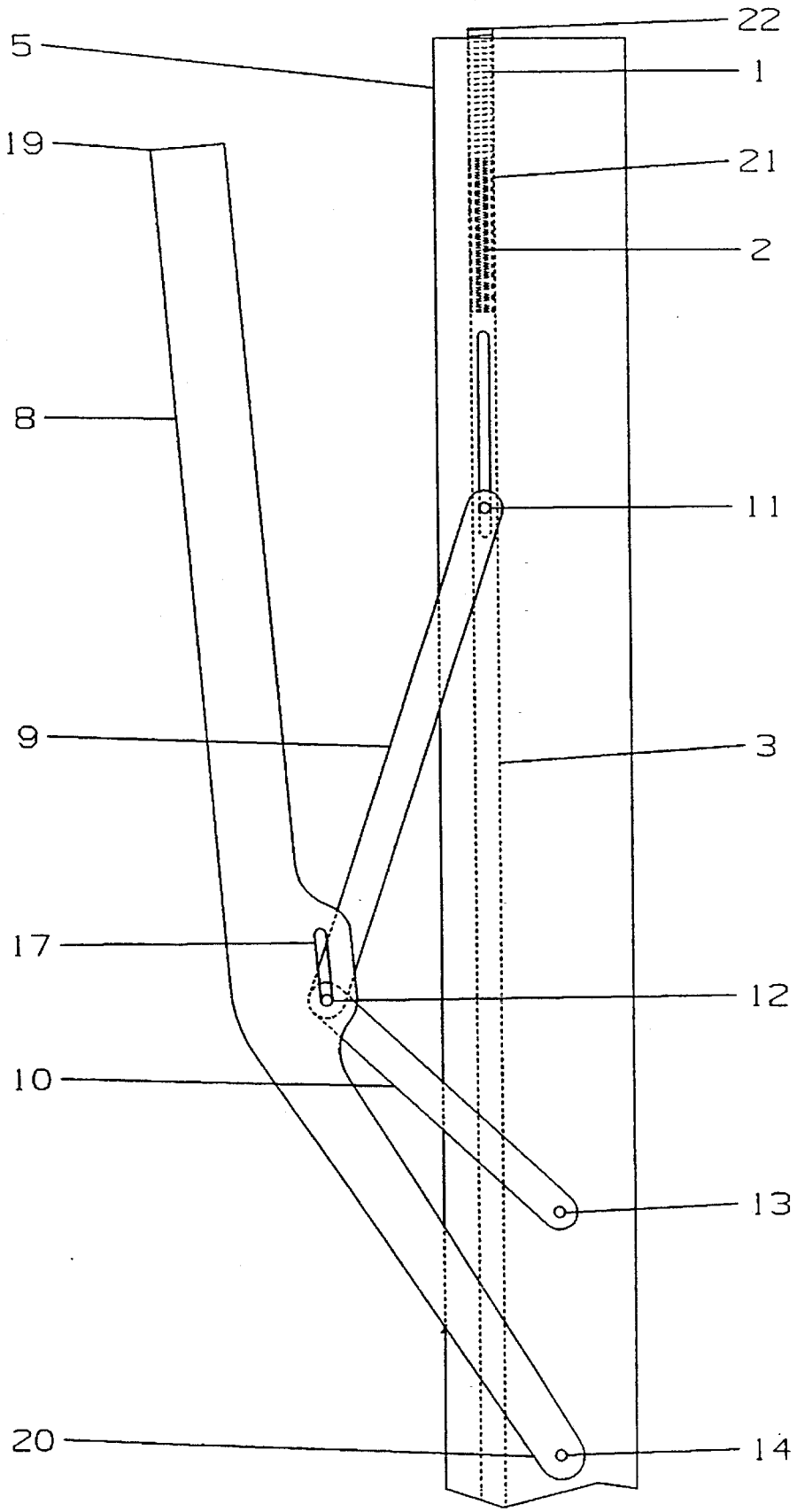
FIG. 4 is an enlarged depiction of the details of the releasing means.

When object B is no longer useful, the CQLS may be disengaged to reduce the force between objects A and B, thereby releasing object B from object A, by pressing scissor jack release lever 8. As depicted in FIGS. 1 and 2 and in greater detail in FIG. 4, lever 8 is fixedly joined at its front end 20 to handle 5 via first anchor 14. The lever is slightly bent near the midpoint of its length and has slot 17 at the bend. Into slot 17, common joint 12 is mounted slidably so that the joint may move along the length of the slot upon being motivated. The common joint is formed by joining first link 9 and second link 10 as shown in the figures. First link 9 is also fixedly attached to detent 3 at sliding pin 11 while second link 10 is fixedly attached to handle 5 at second anchor 13.

To activate the disengaging process, back end 19 of lever 8 is pressed down to make contact with handle 5. This causes second link 10 to slide common joint 12 up in slot 17 which, in turn, causes first link 9 to move toward spring 2, thereby pulling detent 3 out of the notch in which it had been resting while the handle was in the horizontal position. With the detent thusly released from the notch and lever 8 still pressed against the handle, the handle is then rotated in clockwise direction until the detent catches cam stop 16 shown in FIG. 3. The detent pressing on the cam stop mechanically links the handle to the cam. Now, the cam rotates with the handle in clockwise direction which lowers pivot pin 6. The clockwise motion can be ended when the handle is once again in the vertical position. At this point, there is no longer force between objects A and B. This completes the disengaging process and object B may be removed from hook 7.

Although a particular embodiment and form of the CQLS has been illustrated by the foregoing, it is apparent that various modifications and embodiments of the invention may be made by those skilled in the art without departing from the scope and spirit of the foregoing disclosure. Some of such modifications are: adjusting the shape of the cam to change the amount and rate of force that is placed on the objects A and B; altering the maximum amount of force transferred between the handle and cam by changing the shape and steepness of the angles of the notch and tip 23 of the detent, respectively, and by changing the coefficient of friction between the cam and the detent; adjusting the amount of force between the detent and the cam by using a different strength of spring or by rotating screw 1 by varying degrees. Further, lever 8 can be adjusted to pull the detent out of a notch at different distances or make the detent easier to move. The length of the handle can also be varied, thereby changing the amount of effort required to operate it. It is noted that the material used will also determine the strength of the CQLS and the mount of friction between the components.

The relative ease with which adjustments can be made to the CQLS makes the system highly adaptable to future changes in the amount of force necessary to hold launchers, for example, to their mounts. The simplicity of the design and the ability to vary its components in a variety of ways allows the CQLS to be used in a multitude of applications. Accordingly, the scope of the invention should be limited only by the claims appended hereto.

I claim:

1. A system for removably joining a first object with a second object, said system being adapted for securement to the first object and comprising:

a rotatable cam having on the circumference thereof several notches, said cam being susceptible to being motivated by an initiating motion; a hook for hooking thereon the second object, said hook being pivotally coupled to said cam such that said hook rises or falls in response to the rotation of said cam, thereby attaching to or detaching from, respectively, the first object the second object; a handle for supplying said initiating motion and rotating said cam, said handle having a pre-initiating position and being coupled simultaneously and pivotally to said cam and said hook; a detent adapted to enter and exit said notches; and a means for applying a pre-determined amount of pressure to said detent such that said detent enters one of said notches in response to said pressure and causes the rotation of said cam in consonance with the movement of said handle.

2. A system as described in claim 1, wherein said system further comprises a means for selectively releasing said detent from any given notch so as to allow said handle to return to said pre-initiating position, thereby enabling said hook to be lowered.

3. A system as described in claim 2, wherein said pre-initiating position is vertical.

4. A system as described in claim 3, wherein said notches and detent are shaped so as to allow the detent to enter and exit any of said notches only when said handle moves in a given direction, said given direction being consonant with the raising of said hook.

5. A system as described in claim 4, wherein said system still further comprises a transferring means positioned between said means for applying pressure and said detent for transferring the applied pressure from said applying means to said detent.

6. A system as described in claim 5, wherein said releasing means comprises a lever having a front end, a back end, a bend near the midlength of said lever and a slot in said bend, said back end being adapted for making selective contact with said handle and said front end being anchored fixedly to said handle; a first link anchored at one end thereof to said detent and a second link being anchored at one end thereof to said handle, said first and second links being further joined to each other at a common joint, said joint being formed by said first and second links 3 respective free ends being coupled together; wherein said common joint is slidably mounted into said slot such that, in response to said back end contacting said handle, said common joint slides within said slot and causes said first link to pull said detent out of a pre-selected notch, thereby allowing said handle to return to the vertical position.

7. A system as described in claim 6, wherein said transferring means is a coil spring.

8. A system as described in claim 7, wherein said handle has a channel therein, said channel housing therein said applying means, spring and detent.

9. A system as described in claim 8, wherein said applying means is a screw.

10. A system as described in claim 9, wherein said cam further comprises a cam stop located on the surface of said cam to co-operate with said detent to halt the rotation of said handle relative to said cam.

11. A latch for attaching to and detaching from a first object a second object, the first object having a hole therethrough; said latch being adapted for securement onto the first object and comprising:

a rotatable cam having a plurality of notches on the surface thereof, said cam being for residing on the first object; a means for rotating said cam; a screw for applying a pre-determined amount of pressure; a detent adapted to slide in and out of said notches, said detent being positioned to receive said pressure from said screw and, in response thereto and in cooperation with said rotating means, cause the rotation of said cam; a means for releasing said detent from a given notch; a hook for hooking the second object thereon, said hook passing through the hole in the first object and further being coupled pivotally to said cam so as to rise or fall in response to the rotation of said cam, thereby attaching to or detaching from, respectively, the first object the second object.

12. A latch as set forth in claim 11, wherein said rotating means comprises a handle, said handle being pivotally coupled simultaneously to said cam and said hook, said handle further having a tubular channel therethrough.

13. A latch as set forth in claim 12, wherein said latch further comprises a spring, said spring being positioned between said screw and said detent to transfer the applied pressure from said screw to said detent.

14. A latch as set forth in claim 13, wherein said detent, spring and screw are serially housed within said channel.

15. A latch as set forth in claim 14, wherein said notches extend along a quarter of the circumference of said cam and are structured such that said detent slides in and out of said notches only when said cam rotates in a given direction.

16. A latch as set forth in claim 15, wherein said releasing means comprises a lever, one end of said lever being fixedly anchored onto said handle and a plurality of links, said links being movably coupled between said lever and said detent to pull said detent out of a pre-selected notch in response to the motion of said lever.

17. A latch as set forth in claim 16, wherein said lever has a bend at approximately midpoint along the length of said lever, said bend having therein an elongated slot.

18. A latch as set forth in claim 17, wherein said plurality of links comprises a first link fixedly attached at one end thereof onto said detent, a second link fixedly attached at one end thereof onto said handle, said links being joined to each other at their respective unattached ends, thereby forming a common joint, said first and second links being further mounted at said common joint movably into said slot in said lever so that said second link pulls said detent out of a pre-selected notch in response to the motion of said lever.

19. A latch as set forth in claim 18, wherein said cam further comprises a cam stop located on the surface of said cam to co-operate with said detent to halt the rotation of said handle relative to said cam.

* * * * *